United States Patent [19]

Bonham et al.

[11] 4,318,607

[45] Mar. 9, 1982

[54] MAGNET FOR A DEVELOPMENT SYSTEM

[75] Inventors: Robert D. Bonham, Ontario; Joseph Fantuzzo, Webster, both of N.Y.

[73] Assignee: Xerox Corporation, Stamford, Conn.

[21] Appl. No.: 168,871

[22] Filed: Jul. 14, 1980

[51] Int. Cl.[3] ..... G03G 15/00

[52] U.S. Cl. ..... 355/3 DD; 118/657

[58] Field of Search ..... 355/3 DD; 118/657, 658, 118/623, 653, 656; 430/122

[56] References Cited

U.S. PATENT DOCUMENTS

| | | | |
|---|---|---|---|
| 3,392,432 | 7/1968 | Naumann | 355/3 DD |
| 3,552,355 | 1/1971 | Flint | 118/657 X |
| 4,267,248 | 5/1981 | Yamashita et al. | 430/122 |

*Primary Examiner*—Richard L. Moses

*Attorney, Agent, or Firm*—H. Fleischer; H. M. Brownrout

[57] ABSTRACT

An apparatus which develops a latent image by transporting developer material closely adjacent thereto. The apparatus includes a magnetic member having a magnetic portion formed integrally with a support portion.

17 Claims, 4 Drawing Figures

MAGNET FOR A DEVELOPMENT SYSTEM

This invention relates generally to an electrophotographic printing machine, and more particularly concerns a system for developing a latent image recorded on a surface with charged particles.

Generally, an electrophotographic printing machines includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Various types of development systems have heretofore been employed to deposit particles on the electrostatic latent image. For example, cascade systems utilize a bucket conveyor system for moving the developer material in an upwardly direction and then permitting it to cascade downwardly over the electrostatic latent image recorded on the photoconductive member. The electrostatic latent image attracts the toner particles from the carrier granules so as to form a powder image on the photoconductive member corresponding to the informational areas within the original document being reproduced. An improvement on the cascade system is the magnetic brush system. The typical magnetic brush system employs a developer roller having a non-magnetic tubular member with the exterior circumferential surface thereof roughened. A magnetic member is mounted interiorally of the non-magnetic tubular member. As the tubular member rotates, the toner particles and carrier granules are transported into contact with the latent image. The latent image attracts the toner particles from the carrier granules forming a toner powder image on the photoconductive surface. Generally, the magnetic member is an elongated roll or tube which has a series of magnetic poles permanently impressed thereon. The magnet may include a plurality of rings mounted on a common shaft adjacent to one another. Alternatively, bar magnets may be disposed about the periphery of a shaft and secured thereto. However, the support for the magnet is generally separate therefrom.

The following art appears to be relevant in describing typical magnets employed in developer rollers used in electrophotographic printing machines:

U.S. Pat. No. 3,392,432; Patentee: Naumann; Issued: July 16, 1968.

The pertinent portions of the foregoing disclosure may be summarized as follows:

Naumann describes a magnetic roller comprising a magnetizable core having a tube of permanent magnetic material interfit thereover. Another structure depicts a magnetic rod. Still another embodiment shows a plurality of magnetic bars secured to a shaft. A final configuration illustrates arcuate magnetic segments secured to a shaft.

In accordance with the features of the present invention, there is provided an apparatus for developing a latent image. Means transport the developer material closely adjacent to the latent image. A magnetic member, operatively associated with the transport means, attracts the developer material thereto. The magnetic member has a magnetic portion formed integrally with a support portion.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
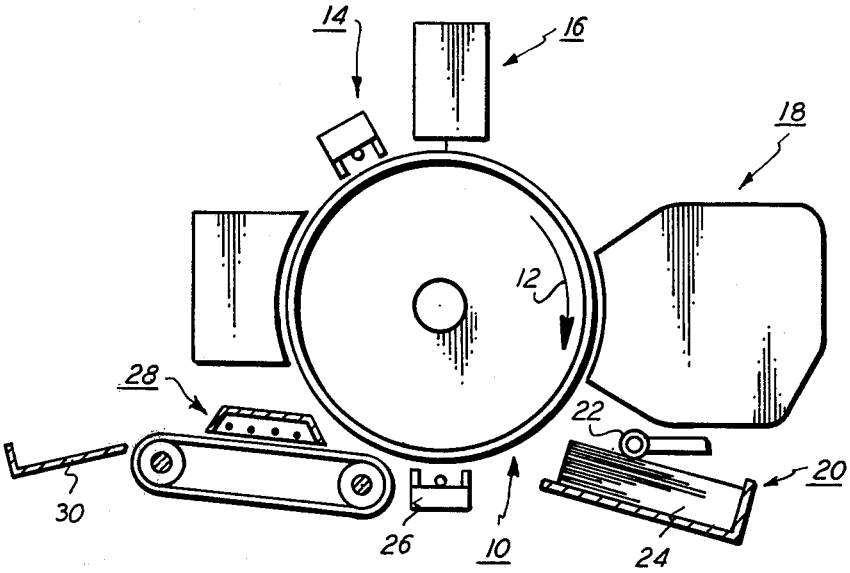
FIG. 1 is an elevational view showing schematically an electrophotographic printing machine incorporating the features of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts an electrophotographic printing machine showing the various processing stations thereof disposed therein. Although the development system of the present invention is particularly well adapted for use in an electrophotographic printing machine, it will become evident from the following discussion that it is equally suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a drum 10 having the outer periphery thereof coated with a suitable photoconductive material. Preferably, drum 10 is made from a conductive substrate, such as aluminum, having the photoconductive material, e.g. a selenium alloy, deposited directly thereon. Drum 10 rotates in the direction of arrow 12 to pass through the various processing stations disposed thereabout.

Initially, drum 10 moves a portion of the photoconductive surface through charging station A. At charging station A, a corona generating device, indicated generally by the reference numeral 14, charges the photoconductive surface of drum 10 to a relatively high, substantially uniform potential.

Thereafter, the charged portion of the photoconductive surface of drum 10 is advanced through exposure station B. At exposure station B, an original document is positioned face-down upon a transparent platen. The exposure system, indicated generally by the reference numeral 16, includes lamps which move across the original document illuminating incremental with thereof.

The light rays reflected from the original document are transmitted through a moving lens forming incremental width light images. The lens focuses these light images onto the charged portion of the photoconductive surface. In this manner, the charged photoconductive surface of drum 10 is discharged selectively by the light image of the original document. This records an electrostatic latent image on the photoconductive surface of drum 10 which corresponds to the informational areas contained within the original document.

Next, drum 10 advances the electrostatic latent image recorded on the photoconductive surface to development station C. At development station C, a magnetic brush development system, indicated generally by the reference numeral 18, advances developer material into contact with the electrostatic latent image recorded on the photoconductive surface of drum 10. Preferably, the developer material comprises carrier granules having toner particles adhering triboelectrically thereto. The magnetic brush development system forms a chain-like array of developer material extending outwardly therefrom. The developer material contacts the electrostatic latent image recorded on the photoconductive surface of drum 10. The latent image attracts the toner particles from the carrier granules forming a toner powder image on the photoconductive surface of drum 10. The detailed structure of development system 18 will be shown hereinafter with reference to FIGS. 2 through 4, inclusive.

The toner powder image recorded on the photoconductive surface of drum 10 is then transported to transfer station D. At transfer station D, a sheet of support material is positioned in contact with the toner powder image deposited on the photoconductive surface of drum 10. The sheet of support material is advanced to transfer station D by a sheet feeding apparatus, indicated generally by the reference numeral 20. Preferably, sheet feeding apparatus 20 includes a feed roll 22 contacting the uppermost sheet of a stack 24 of sheets of support material. Feed roll 22 rotates so as to advance the uppermost sheet from stack 24. Registration rollers align and forward the advancing sheet of support material into a chute. The chute directs the advancing sheet of support material into contact with the photoconductive surface of drum 10 in a timed sequence so that the powder image thereon contacts the advancing sheet of support material at transfer station D.

Transfer station D includes a corona generating device 26 which applies a spray of ions to the backside of the sheet of support material. This attracts the toner powder image from the photoconductive surface of drum 10 to the sheet. After transfer, the sheet continues to move the drum 10 and is separated therefrom by a detack corona generating device (not shown) which neutralizes the charge causing the sheet to adhere to drum 10. A conveyor system advances the sheet from transfer station D to fusing station E.

Fusing station E includes a fuser assembly, indicated generally by the reference numeral 28, which heats the toner powder image sufficiently to permanently affix it to the sheet. Fuser assembly 28 includes an outer shield, a reflector and radiant heating elements supported by quartz rods. Power is supplied to the heating element by an adjustable transformer. A blower is provided for cooling.

After fusing, a series of conveyors advance the sheet of support material with the powder image permanently affixed thereto to catch tray 30. When the sheet of support material is in catch tray 30, it may be readily removed from the printing machine by the operator.

Invariably, after the sheet of support material is separated from the photoconductive surface of drum 10, some residual particles remain adhering thereto. These residual particles are removed from drum 10 at cleaning station F. Preferably, cleaning station F includes a rotatably mounted fibrous brush in contact with the photoconductive surface of drum 10. The particles are cleaned from the photoconductive surface by the rotation of the brush. Subsequent to cleaning, a discharge lamp floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
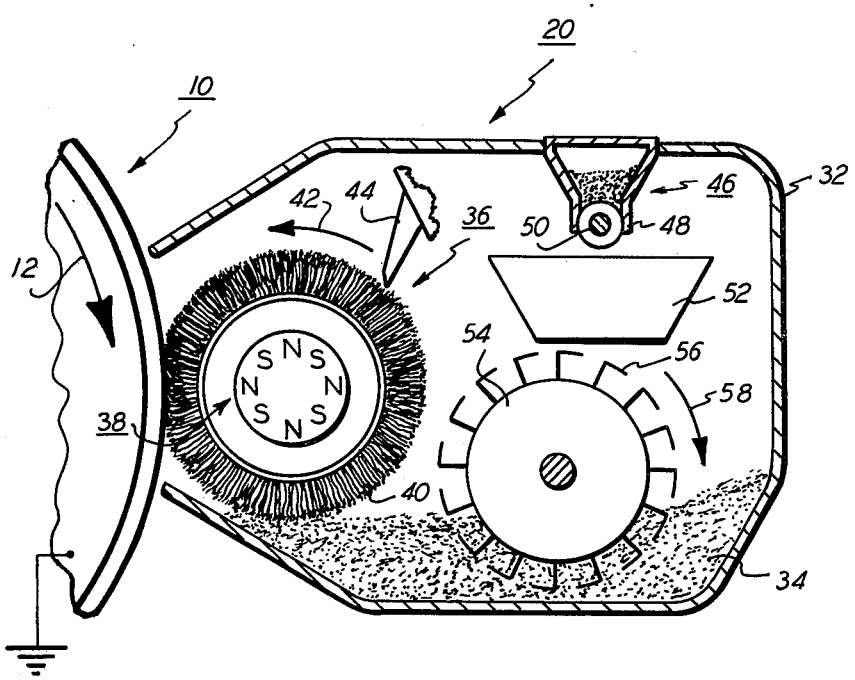
FIG. 2 is an elevational view depicting a development system used in the FIG. 1 printing machine.

Referring now to FIG. 2, development system 18 is depicted thereat in greater detail. As shown in FIG. 2, development system 18 includes a housing 32 storing a supply of developer material 34 comprising carrier granules and toner particles therein. A developer roller, indicated generally by the reference numeral 36, is positioned in housing 32 and arranged to transport developer material 34 into contact with the photoconductive surface of drum 10. Developer roller 36 includes magnetic member 38 mounted interiorly of tubular member 40. Tubular member 40 rotates, in the direction of arrow 42, while magnetic member 38 remains substantially stationary. Preferably, tubular member 40 is made from aluminum having the exterior circumferential surface thereof roughened. The detailed structure of magnetic member 38 is shown hereinafter with reference to FIGS. 3 and 4. As tubular member 40 rotates in the direction of arrow 42, it transports developer material into contact with the latent image recorded on the photoconductive surface of drum 10. Toner particles are attracted from the carrier granules to form a toner powder image thereon. Metering blade 44 has the free end region thereof positioned closely adjacent to tubular member 40 to define a gap therebetween. This gap regulates the quantity of developer material advanced into contact with the latent image. Developer roller 36 is electrically biased to a potential of sufficient magnitude and polarity so as to optimize development of the latent image while minimizing development of the background areas.

After a large number of copies have been reproduced, toner particles tend to be depleted from the developer material. This results in a gradual degradation in the quality of the copies being reproduced. In order to overcome this problem, additional toner particles must be furnished to the developer material. A toner dispenser, indicated generally by the reference numeral 46, supplies toner particles to the developer material. Toner dispenser 46 includes a hopper 48 having a supply of toner particles therein. A roller 50, preferably made from a polyurethane material, is disposed in the lowermost aperture of hopper 48. As roller 50 rotates, it dispenses toner particles from hopper 48 into developer material 34. This maintains the concentration of toner particles within the developer material substantially constant.

As the toner particles descend from toner dispenser 46, they pass through a passive mixing device 52. Passive mixing device 52 intermingles the developer material with the newly descending toner particles so as to produce a developer mixture having the desired triboelectric characteristics. Preferably, passive device 52 includes a plurality of baffles arranged to have the developer material and toner particles intermingles with one another. The baffles of mixing device 52 may be foreshortened and arranged angularly so as to cause the toner particles to flow from the outer end inwardly with the speed of the toner particles varying depending upon the channel which they pass through. In this way, the toner particles intermingle with the developer material so as to form a substantially homogeneous mixture. After the developer material passes through mixing device 52, it descends to the sump of housing 32. A substantially cylindrical member 54 having a plurality of vanes or buckets 56 extending outwardly therefrom, rotates, in the direction of arrow 58, to advance the developer material to developer roller 36. Developer roller 36 transports the developer material in the direction of arrow 42. Metering blade 44 controls the quantity of developer material transported into contact with the latent image recorded on the photoconductive surface of drum 10.

Figure 3:
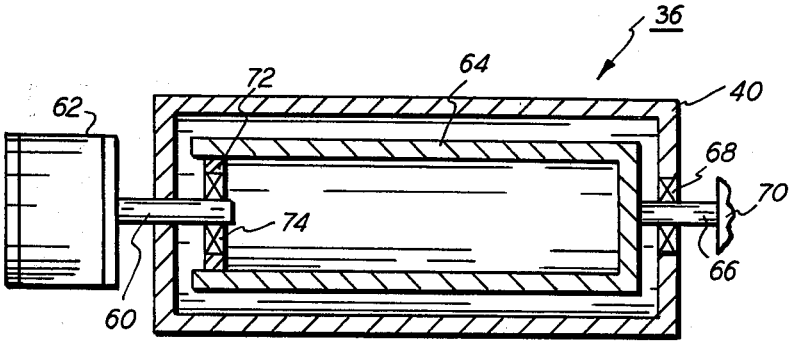
FIG. 3 is an elevational view showing a developer roller used in the FIG. 2 development system.

Turning now to FIG. 3, there is shown the detailed structure of developer roller 36. As depicted thereat, tubular member 40 is coupled to shaft 60 of motor 62. Motor 62 rotates tubular member 40 at a substantially constant angular velocity so as to transport the developer material into contact with the latent image. Magnetic member 38 includes a magnetic portion 64 and a support portion 66. Magnetic portion 64 is a hollow cylindrical member. Support portion 66 is a shaft molded integrally with cylindrical member 64. Tubular member 40 is mounted on ball bearings 68 secured to shaft 66. Shaft 66 is mounted fixedly in frame 70 of the printing machine. The other end portion of cylindrical member 64 has a bearing support 72 molded integrally therewith. Preferably, bearing support 72 is a ring. Bearing support 72 may be made from the same material as magnetic portion 64 or, in the alternative, from a suitable stainless steel molded integrally with magnetic portion 64. Ball bearings 74 mounted on bearing support 72 support shaft 60 rotatably. Preferably, shaft 66 is cylindrical. Both shaft 66 and cylindrical member 64 are preferably formed by injection molding. By way of example, both cylindrical member 64 and shaft 66 are made preferably from a material which is suitable for injection molding, such as a magnetizable plastic.

Figure 4:
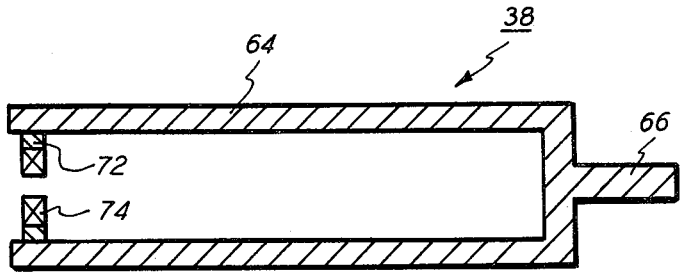
FIG. 4 is an elevational view illustrating the magnetic member of the FIG. 1 developer roller.

Turning now to FIG. 4, the detailed structure of magnetic member 38 is shown thereat. Magnetic member 38 includes a hollow cylindrical magnetic portion 64 molded integrally with a cylindrical shaft 68. Shaft 68 is disposed on one end portion of cylindrical member 64. A ring shaped bearing support 72 is molded integrally with cylindrical member 64 at the other end region thereof. The exterior diameter of cylindrical member 64 is greater than the exterior diameter of shaft 68. Magnetic member 38 is formed by injection molded. In injection molding, a measured amount of magnetizable plastic material is injected into a mold in liquid form. This method is believed to be the most appropriate process for forming magnetic member 38.

In recapitulation, the development apparatus of the present invention utilizes a developer roller comprising a magnetic member having the magnetic portion and the support portion thereof molded integrally with one another. This significantly reduces the complexity and cost of the magnetic member.

It is, therefore, evident that there has been provided in accordance with the present invention a development system which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image with developer material, including:
   means for transporting the developer material closely adjacent to the latent image; and
   a magnetic member, disposed interiorly of said transporting means, for attracting the developer material thereto, said magnetic member having a magnetic portion molded integrally with a support portion.

2. An apparatus according to claim 1, further including a frame arranged to receive said support portion of said magnetic member therein.

3. An apparatus for developing a latent image with developer material, including:
   means for transporting the developer material closely adjacent to the latent image;
   a magnetic member operatively associated with said transporting means for attracting the developer material thereto, said magnetic member having a magnetic portion formed integrally with a support portion, said magnetic portion of said magnetic member being an elongated cylindrical member, and said support portion of said magnetic member being a shaft molded integrally with at least one end region of said cylindrical member; and
   a frame arranged to receive said support portion of said magnetic member therein.

4. An apparatus according to claim 3, wherein said cylindrical member is hollow.

5. An apparatus according to claim 4, further including a bearing support positioned at the other end region of said cylindrical member.

6. An apparatus according to claim 5, wherein said bearing support is molded integrally with said cylindrical member.

7. An apparatus according to claim 6, wherein said bearing support is a ring.

8. An apparatus according to claim 7, wherein said shaft is cylindrical.

9. An apparatus according to claim 8, wherein the diameter of said cylindrical member is greater than the diameter of said shaft.

10. An electrophotographic printing machine of the type in which an electrostatic latent image recorded on the photoconductive member is developed with a developer material, wherein the improvement includes:
   means for transporting the developer material closely adjacent to the electrostatic latent image recorded on the photoconductive member; and
   a magnetic member, disposed interiorly of said transporting means, to attract the developer material thereto, said magnetic member having a magnetic portion molded integrally with a support portion arranged to be mounted in the printing machine.

11. An electrophotographic printing machine of the type in which an electrostatic latent image recorded on a photoconductive member is developed with a developer material, wherein the improvement includes:

means for transporting the developer material closely adjacent to the electrostatic latent image recorded on the photoconductive member; and a magnetic member operatively associated with said transporting means to attract the developer material thereto, said magnetic member having a magnetic portion formed integrally with a support portion arranged to be mounted in the printing machine, said magnetic portion of said magnetic member being an elongated cylindrical member, and said support portion of said magnetic member being a shaft molded integrally with at least one end region of said cylindrical member.

12. A printing machine according to claim 11, wherein said cylindrical member is hollow.

13. A printing machine according to claim 12, further including a bearing support positioned at the other end region of said cylindrical member.

14. A printing machine according to claim 13, wherein said bearing support is molded integrally with said cylindrical member.

15. A printing machine according to claim 14, wherein said bearing support is a ring.

16. A printing machine according to claim 15, wherein said shaft is cylindrical.

17. A printing machine according to claim 16, wherein the diameter of said cylindrical member is greater than the diameter of said shaft.

* * * * *